US010927595B2

(12) United States Patent
Wang

(10) Patent No.: US 10,927,595 B2
(45) Date of Patent: Feb. 23, 2021

(54) SAFETY GATE

(71) Applicant: Demby Development Co., Ltd., New Taipei (TW)

(72) Inventor: Tsung-Hsiang Wang, New Taipei (TW)

(73) Assignee: Demby Development Co., Ltd., New Taipei (TW)

( * ) Notice: Subject to any disclaimer, the term of this patent is extended or adjusted under 35 U.S.C. 154(b) by 358 days.

(21) Appl. No.: 16/125,314

(22) Filed: Sep. 7, 2018

(65) Prior Publication Data

US 2019/0085620 A1 Mar. 21, 2019

(30) Foreign Application Priority Data

Sep. 15, 2017 (CN) ..... 201721190203.7

(51) Int. Cl.

| | |
|---|---|
| ***E06B 9/02*** | (2006.01) |
| ***E06B 9/06*** | (2006.01) |
| ***E05B 65/00*** | (2006.01) |
| *E06B 9/00* | (2006.01) |

(52) U.S. Cl.

CPC ..... *E06B 9/0638* (2013.01); *E05B 65/0007* (2013.01); *E06B 9/02* (2013.01); *E06B 2009/002* (2013.01)

(58) Field of Classification Search

CPC ..... E06B 11/02; E06B 2009/002; E06B 9/02; E06B 9/0638; E06B 9/06; E06B 9/0623; E06B 11/022; E05B 65/0007

See application file for complete search history.

(56) References Cited

U.S. PATENT DOCUMENTS

| | | | | |
|---|---|---|---|---|
| 4,702,036 | A * | 10/1987 | Johnson | E06B 9/02 49/394 |
| 7,887,029 | B2 * | 2/2011 | Flannery | E06B 9/06 256/73 |
| 8,468,749 | B1 * | 6/2013 | Dufresne | E06B 11/045 49/404 |
| 2006/0231821 | A1 * | 10/2006 | Gavin | E06B 11/02 256/73 |

(Continued)

FOREIGN PATENT DOCUMENTS

| | | | | |
|---|---|---|---|---|
| EP | 2682557 | A2 * | 1/2014 | E05B 65/0007 |

*Primary Examiner* — Johnnie A. Shablack
*Assistant Examiner* — Matthew Richard Shepherd
(74) *Attorney, Agent, or Firm* — Thomas J. Nikolai; DeWitt LLP

(57) ABSTRACT

A safety gate has a main frame, two wall-mounted assemblies, and two connecting assemblies. The two connecting assemblies are respectively and movably mounted on two opposite sides of the main frame. Each connecting assembly has a first connecting part and a second connecting part. Each wall-mounted assembly has a first pivot base and a second pivot base. Each first connecting part is rotatably and detachably connected to a corresponding first pivot base. Each second connecting part is rotatably and detachably connected to a corresponding second pivot base. By detaching and rotating one connecting assembly from the corresponding wall-mounted assembly, the main frame can be closed and opened as a gate. By detaching all the connecting parts from the corresponding bases, the main frame can be easily installed on and disassembled from a place.

12 Claims, 8 Drawing Sheets

(56) References Cited

U.S. PATENT DOCUMENTS

| | | | | |
|---|---|---|---|---|
| 2008/0104888 | A1* | 5/2008 | Holmes | E06B 9/02 49/70 |
| 2012/0258099 | A1* | 10/2012 | Debant | A61P 35/00 424/133.1 |
| 2015/0027060 | A1* | 1/2015 | Sousa | E05B 53/001 49/394 |
| 2017/0211314 | A1* | 7/2017 | Raffi | E06B 9/04 |

* cited by examiner

SAFETY GATE

CROSS-REFERENCE TO RELATED APPLICATIONS

This application is based upon and claims priority under 35 U.S.C. 119 from China Patent Application No. 201721190203.7 filed on Sep. 15, 2017, which is hereby specifically incorporated herein by this reference thereto.

BACKGROUND OF THE INVENTION

1. Field of the Invention

The present invention relates to a gate, especially to a safety gate.

2. Description of the Prior Arts

A conventional safety gate has a main frame, a rotating shift, and a door lock. The rotating shift and the door lock are mounted on two opposite sides of the main frame. The rotating shift is mounted on a wall. The door lock is selectively mounted on another wall, and can make the main frame locked or unlocked against the wall.

However, it is complicated to install and disassemble the conventional safety gate from one place to another place, so the conventional safety gate is inconvenient to use.

To overcome the shortcomings, the present invention provides a safety gate to mitigate or obviate the aforementioned problems.

SUMMARY OF THE INVENTION

The main objective of the present invention is to provide a safety gate that is convenient to install and disassemble.

The safety gate has a main frame, two connecting assemblies, and two wall-mounted assemblies, and the two connecting assemblies are respectively mounted on two opposite sides of the main frame. Each one of the two connecting assemblies is movably mounted on the main frame and comprises a first connecting part and a second connecting part, and the first connecting part and the second connecting part are arranged apart from each other.

The two wall-mounted assemblies are disposed on the two opposite sides of the main frame respectively, are adjacent to the two connecting assemblies respectively, and are detachably connected to the two connecting assemblies respectively. Each one of the two wall-mounted assemblies comprises a first pivot base and a second pivot base, the first connecting part of the adjacent connecting assembly is detachably and pivotally connected to the first pivot base, and the second connecting part of the adjacent connecting assembly is detachably and pivotally connected to the second pivot base.

The two connecting assemblies have a pivoting condition and a disassembling condition.

In the pivoting condition, one of the two connecting assemblies is operated to make the first connecting part and the second connecting part of said connecting assembly detached from the first pivot base and the second pivot base of the corresponding wall-mounted assembly respectively, so the main frame is capable of pivoting along the other connecting assembly, and the main frame is capable of opening or closing.

In the disassembling condition, both of the two connecting assemblies are operated to make the first connecting part and the second connecting part of each one of the two connecting assemblies detached from the first pivot base and the second pivot base of the corresponding wall-mounted assembly respectively, and the main frame is capable of being removed from the two wall-mounted assemblies.

Given the foregoing structure of the safety gate, the two wall-mounted assemblies are respectively mounted on two side walls that are disposed on two opposite sides of an aisle. Each wall-mounted assembly has a first pivot base and a second pivot base; specifically, the first pivot base and the second pivot base are both mounted on a side of the wall-mounted assembly that is away from the side wall where the wall-mounted assembly is mounted.

The two connecting assemblies are respectively and movably mounted on two opposite sides of the main frame, and the positions of the two connecting assemblies correspond to the positions of the two wall-mounted assemblies. Each connecting assembly has a first connecting part and a second connecting part. The first connecting part is detachably and pivotally connected to the adjacent first pivot base. The second connecting part is detachably and pivotally connected to the adjacent second pivot base. The first connecting part and the second connecting part can be detached from the corresponding first pivot base and second pivot base.

By detaching one connecting assembly from the corresponding wall-mounted assembly, a user may rotate the main frame against the other connecting assembly; in other words, the user may open or close the main frame relative to the wall-mounted assembly that is detached from the main frame.

By detaching the two connecting assemblies from the two wall-mounted assemblies, the user may detach the main frame from the two wall-mounted assemblies. It is equivalent of having a rotating unit and a locking unit on both sides of the main frame. Therefore, the user may unlock and open the main frame from either side of the main frame, and use the other side as a rotating shift. When the user wants to disassemble the main frame, the user only needs to detach the two connecting assemblies from the two corresponding wall-mounted assemblies. Therefore the installing and disassembling process of the present invention is fast and convenient.

Furthermore, if the user wants to install the detached main frame onto another position (e.g. doorway or staircase), he/she only needs to install another two wall-mounted assemblies onto the corresponding side walls and connect the main frame to said wall-mounted assemblies. In other words, by having a single main frame with two connecting assemblies on it, when the user has mounted multiple wall-mounted assemblies on different places, the main frame can be easily installed from place to place.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
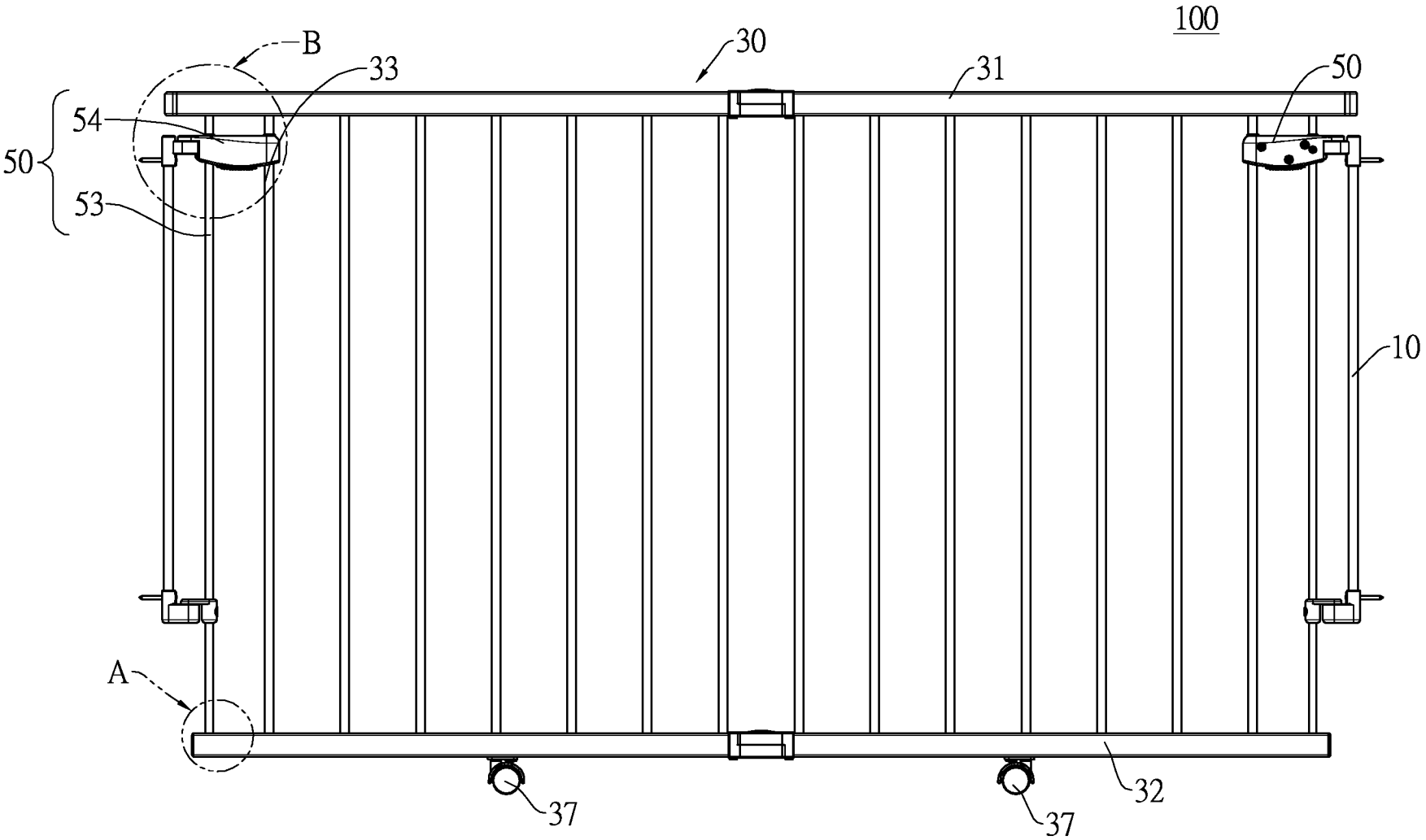
FIG. 1 is a front view of a safety gate in accordance with the present invention.

With reference to FIG. 1, a safety gate 100 in accordance with the present invention comprises a main frame 30, two wall-mounted assemblies 10, and two connecting assemblies 50. The two connecting assemblies 50 are respectively mounted on two opposite sides of the main frame 30. Each connecting assembly 50 is movably mounted on the main frame 30. The two wall-mounted assemblies 10 correspond in position to the two connecting assemblies 50. The connecting assemblies 50 have a pivoting condition and a disassembling condition. In the pivoting condition, the user operates one of the two connecting assemblies 50, so the main frame 30 may be unlocked and detached from one of the wall-mounted assemblies 10, being rotatable against the other wall-mounted assembly 10. Therefore, the main frame 30 may be opened or closed on either side, so the safety gate 100 is convenient to use.

On the other hand, in the disassembling condition, by operating both of the connecting assemblies 50, the main frame 30 can be unlocked and detached from both of the wall-mounted assemblies 10, so the disassembling process of the main frame 30 is also convenient.

Specifically, the two connecting assemblies 50 are respectively mounted on two opposite sides of the main frame 30. Through the connecting relation between each connecting assembly 50 and the corresponding wall-mounted assembly 10, the main frame can block a passage between two side walls or between two objects.

With reference to FIG. 1, the main frame 30 comprises a first horizontal rod 31, a second horizontal rod 32, and multiple supporting rods 33. The first horizontal rod 31 and the second horizontal rod 32 are arranged apart from each other, wherein the first horizontal rod 31 is disposed on a place above the second horizontal rod 32. The multiple supporting rods 33 are mounted between the first horizontal rod 31 and the second horizontal rod 32, and the supporting rods 33 are arranged apart from and parallel to each other. Specifically, for each supporting rod 33, two opposite ends are respectively connected to the first horizontal rod 31 and the second horizontal rod 32.

Figure 4:
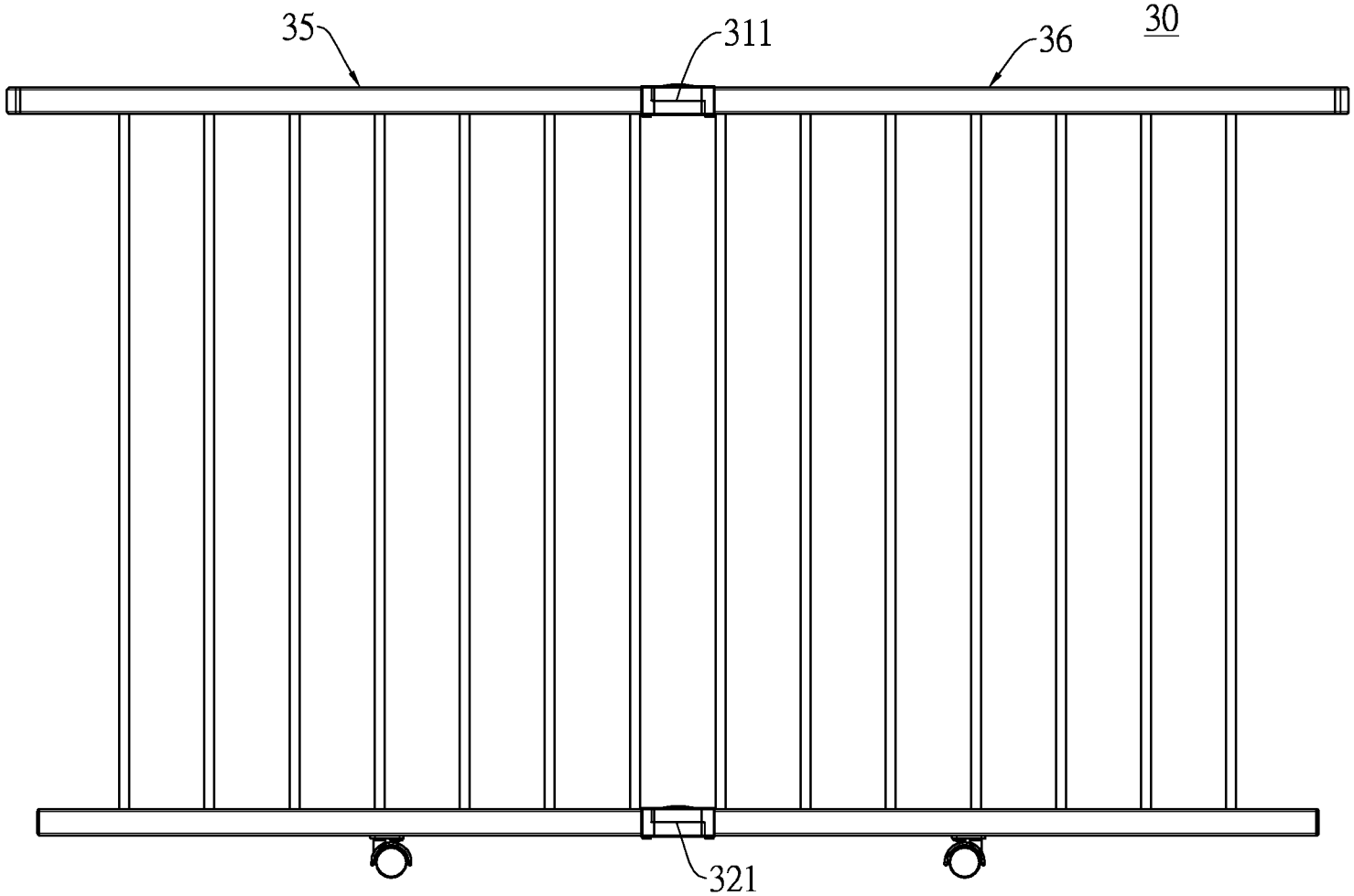
FIG. 4 is a front view of another embodiment of the safety gate in accordance with the present invention.

With reference to FIG. 4, in a preferred embodiment, the main frame 30 further comprises a first rotating unit 311 and a second rotating unit 321. The first rotating unit 311 and the second rotating unit 321 are disposed vertically and arranged apart from each other. In this preferred embodiment, the main frame 30 is divided by the two rotating units 311, 321 into a first frame portion 35 and a second frame portion 36, and the first frame portion 35 and the second frame portion 36 are horizontally disposed.

The two frame portions 35, 36 are pivotally connected to each other through the two rotating units 311, 321. Specifically, a pivot angle between the two frame portions 35, 36 is from 0 degree to 180 degrees, which means the first frame portion 35 can horizontally pivot relative to the second frame portion 36 from 0 to 180 degrees, so the first frame portion 35 can be folded with the second frame portion 36, and vice versa. The pivoting ability of the two frame portions 35, 36 allows the safety gate 100 to be capable of fitting into places with different widths between two walls or objects.

Figure 8:
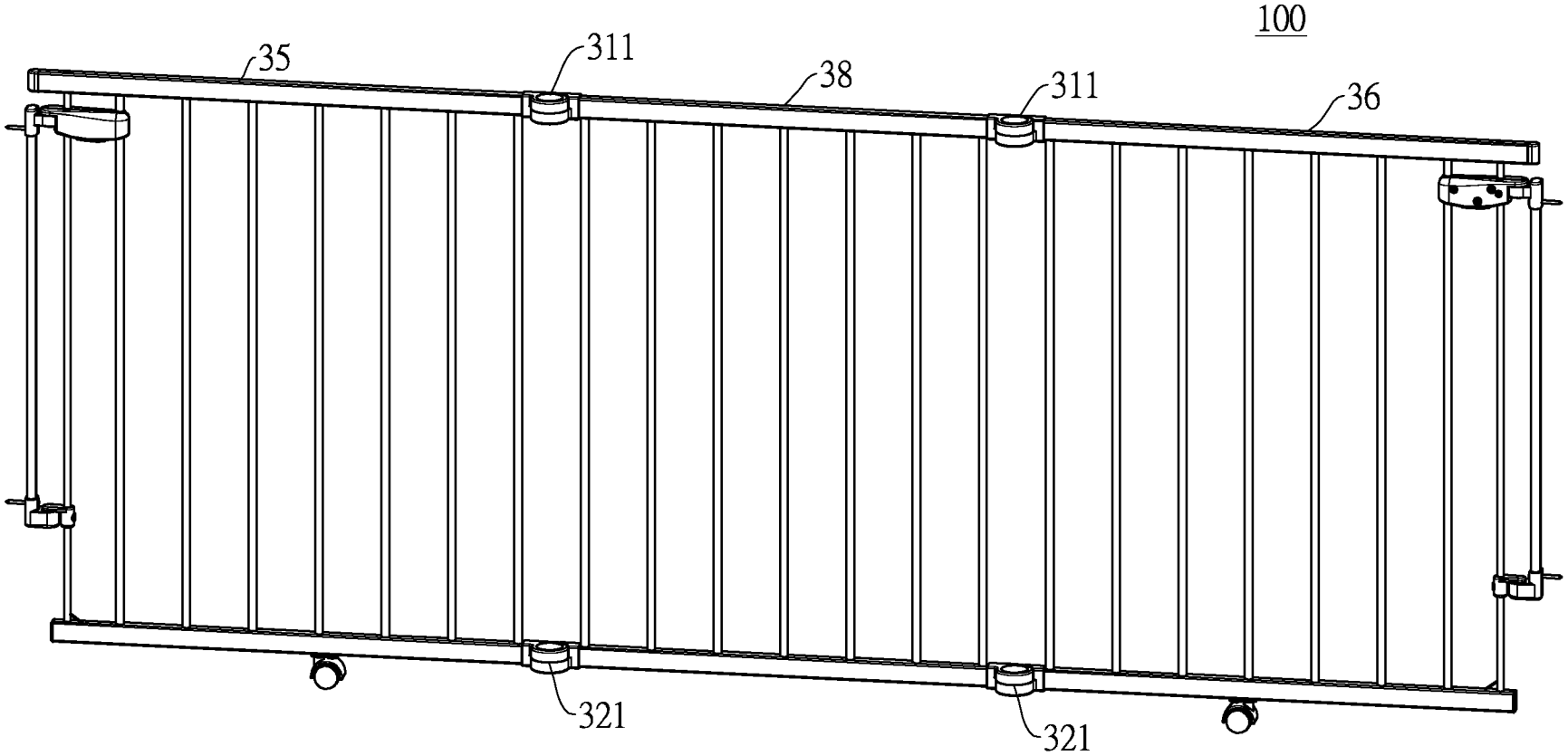
FIG. 8 is another embodiment of the safety gate in accordance with the present invention.

With reference to FIG. 8, to further enhance the practicality of the safety gate 100, at least one extended frame 38 may be detachably mounted between the first frame portion 35 and the second frame portion 36 to extend the overall width of the safety gate 100. In the preferred embodiment, the at least one extended frame 38 is multiple in number, but it is not limited thereto. In the preferred embodiment, each one of the multiple extended frames 38 is pivotally connected between the first frame portion 35 and the second frame portion 36, but it is not limited thereto.

With reference to FIG. 1, in another embodiment, multiple supporting units 37 may be mounted under the main frame 30, specifically, under the second horizontal rod 32. The supporting units 37 may enhance the weight bearing ability of the safety gate 100. Preferably, the supporting units 37 are wheels, which may lower the friction between the main frame 30 and a ground when the main frame 30 is being moved on the ground to be opened or closed.

The wall-mounted assemblies 10 are respectively mounted on two side walls or two objects disposed on two opposite sides of the passage, so when the main frame 30 is to be mounted on the passage, two sides of the main frame 30 may be detachably connected to the corresponding wall-mounted assemblies 10.

Figure 5:
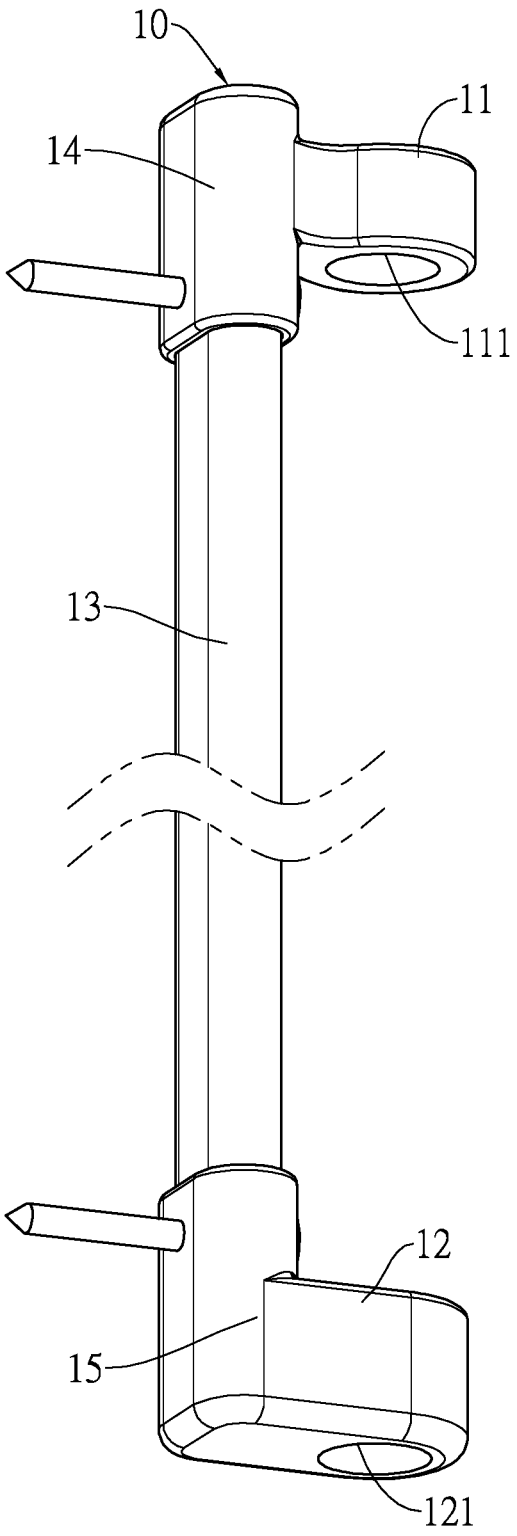
FIG. 5 is a perspective view of the wall-mounted assembly in accordance with the present invention.

With reference to FIG. 5, each wall-mounted assembly 10 comprises a first pivot base 11, a second pivot base 12 and a connecting portion 13. The first pivot base 11 and the second pivot base 12 are respectively mounted on two opposite ends of the connecting portion 13. When the main frame 30 is connected to the two wall-mounted assemblies 10, the first pivot base 11 and the second pivot base 12 of one wall-mounted assembly 10 are detachably connected to the corresponding connecting assembly 50 mounted on one side of the main frame 30, so that side of the main frame 30 is selectively locked by the wall-mounted assembly 10.

In the preferred embodiment, each wall-mounted assembly 10 further comprises a first connecting portion 14 and a second connecting portion 15, and the first connecting portion 14 and the second connecting portion 15 are respectively mounted on two opposite ends of the connecting portion 13. The first pivot base 11 is integrated to the first connecting portion 14, and the second pivot base 12 is integrated to the second connecting portion 15. A first installation hole 111 is formed through the first pivot base 11, and a second installation hole 121 is formed through the second pivot base 12. The first installation hole 111 and the second installation hole 121 are for detachably connecting with the connecting assemblies 50. In the preferred embodiment, a center line of the first installation hole 111 and a center line of the second installation hole 121 are coaxial.

Specifically, the first connecting portion 14 and the second connecting portion 15 are respectively mounted around two ends of the connecting portion 13, a mounting unit is mounted through the first connecting portion 14 and the connecting portion 13, and another mounting unit is mounted through the second connecting portion 15 and the connecting portion 13. By the two mounting units, the wall-mounted assembly can be mounted securely on a wall or on an object.

Figure 6:
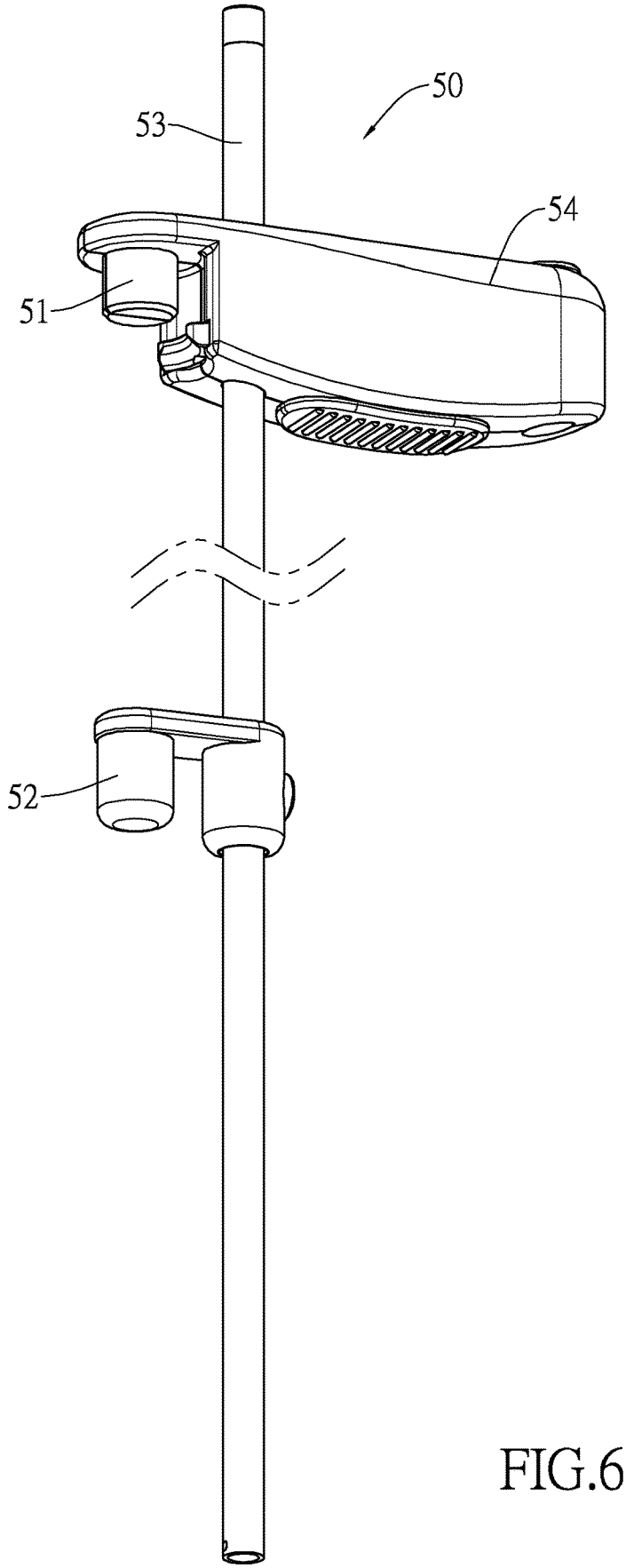
FIG. 6 is perspective view of the connecting assembly in accordance with the present invention.

With reference to FIG. 6, each connecting assembly 50 comprises a first connecting part 51, a second connecting part 52, a connecting rod 53 and an adjusting assembly 54. In the preferred embodiment, the first connecting part 51 and the adjusting assembly 54 are integrated with each other, but it is not limited thereto. The first connecting part 51 and the adjusting assembly 54 are both mounted on an end of the connecting rod 53, and the second connecting part 52 is mounted on another end of the connecting rod 53.

For each connecting assembly 50, the first connecting part 51 is disposed in the first installation hole 111 of the corresponding first pivot base 11, and the second connecting part 52 is disposed in the second installation hole 121 of the corresponding second pivot base 12. In the preferred embodiment, the first connecting part 51 and the second connecting part 52 are, but not limited to, both cylindrical, so the connecting parts 51, 52 can rotate relative to the corresponding bases 11, 12.

Figure 2:
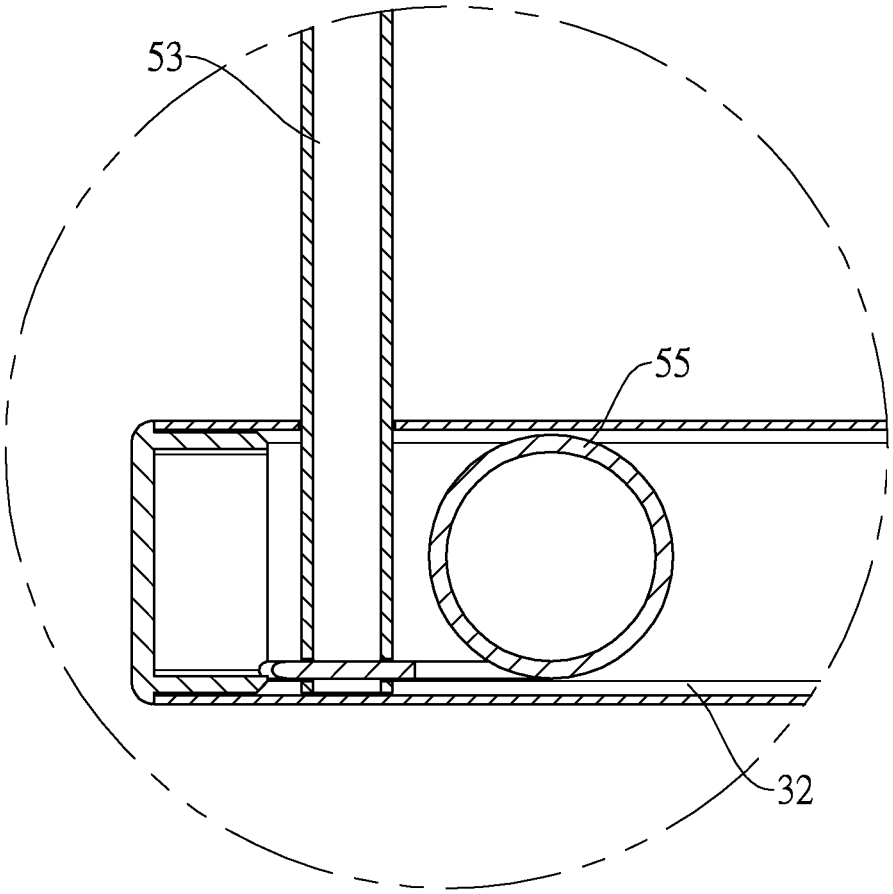
FIG. 2 is a cross sectional and partially enlarged view of the circle A in FIG. 1.

With reference to FIGS. 1 and 2, two opposite ends of the connecting rod 53 are respectively connected to the second horizontal rod 32 and the first horizontal rod 31. Specifically, the end of the connecting rod 53 that is connected to the second horizontal rod 32 is movably connected to the second horizontal rod 32, and the end of the connecting rod 53 that is connected to the first horizontal rod 31 is mounted through the first horizontal rod 31. In the preferred embodiment, the connecting rod 53 is movably connected to the second horizontal rod 32 through a first resilient element 55. Specifically, when the connecting rod 53 is forced and pulled upwardly relative to the main frame 30, the first resilient element 55 is stretched, so when the connecting rod 53 stops being pulled, the first resilient element 55 may pull the connecting rod 53 back to the initial position.

The adjusting assembly 54 has an unlocked condition and a locked condition, described as follows.

In the unlocked condition, the connecting rod 53 is capable of moving up and down relative to the corresponding wall-mounted assembly 10 and the main frame 30, and the connecting rod 53 is also capable of moving up and down with the first connecting part 51, the second connecting part 52, and the adjusting assembly 54 that are mounted on it.

When the connecting rod 53 is moved upwardly relative to the wall-mounted assembly 10, the first connecting part 51 is detached from the corresponding first pivot base 11, and the second connecting part 52 is detached from the corresponding second pivot base 12, so the connecting assembly 50 and the main frame 30 may be detached from the wall-mounted assembly 10.

In the locked condition, the adjusting assembly 54 makes the first connecting part 51 connected securely to the corresponding first pivot base 11, and the second connecting part 52 is connected securely to the corresponding second pivot base 12. Therefore, the main frame 30 is not capable of moving relative to the wall-mounted assembly 10.

With reference to FIG. 1, each adjusting assembly 54 has two opposite sides, one side is near the corresponding connecting rod 53, and the other side is away from the corresponding connecting rod 53. In the preferred embodiment, the side that is away from the connecting rod 53 is movably connected to at least one supporting rod 33, and the connection between the at least one supporting rod 33 and the adjusting assembly 54 enhances the stability of the connecting assembly 50 when moving up and down.

Figure 7:
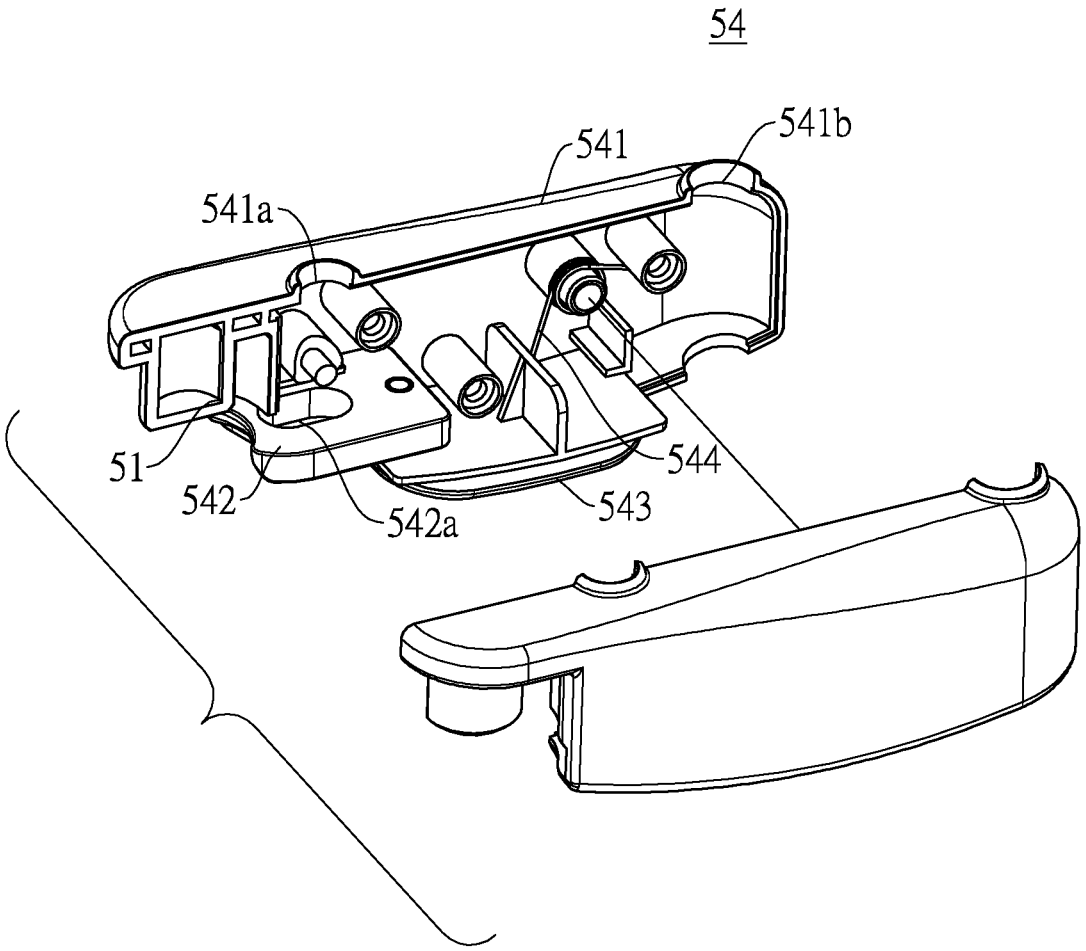
FIG. 7 is an exploded and enlarged view of the adjusting assembly in accordance with the present invention.

With reference to FIG. 7, each adjusting assembly 54 comprises a housing 541, a block 542, and a pushing bottom 543. The first connecting part 51 of said connecting assembly 50 is connected to the housing 541. The block 542 is movably mounted in the housing 541 and is capable of partially protruding out from the housing 541. The pushing bottom 543 is connected to the block 542.

The adjusting assembly 54 can be operated to lock or unlock the main frame 30 from detaching from the corresponding wall-mounted assembly 10. Specifically, with reference to FIG. 3, when the main frame 30 is locked by the adjusting assembly 54, the pushing bottom 543 of the adjusting assembly 54 is moved toward the adjacent wall-mounted assembly 10, and the block 542 protrudes from the housing 541 and abuts the first pivot base 11 of the adjacent wall-mounted assembly 10.

Figure 3:
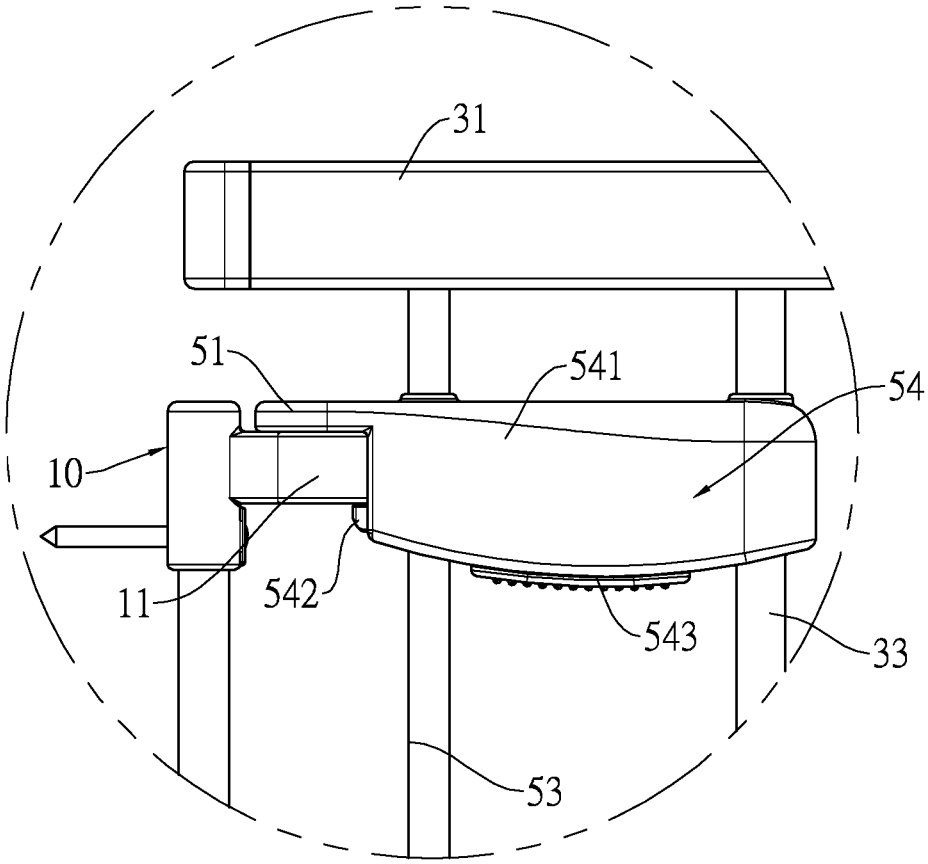
FIG. 3 is an enlarged view of the circle B in FIG. 1.

With reference to FIGS. 1, 3, and 5, after a safety gate 100 is installed, for each connecting assembly 50, the first connecting part 51 is disposed in the first installation hole 111 of the corresponding first pivot base 11. And for the adjusting assembly 54 of the same connecting assembly 50, the block 542 also abuts said first pivot base 11. In other words, the first connecting part 51 and the block 542 are disposed on two opposite surfaces of the first pivot base 11 and clamp the first pivot base 11 in between, so the moving ability of the main frame 30 is limited by the adjusting assembly 54, and also the first connecting part 51 is therefore restricted from detaching from the first pivot base 11.

In the preferred embodiment, each first connecting part 51 is disposed into the first installation hole 111 of the corresponding first pivot base 11 from a position above said first pivot base 11, each second connecting part 52 is disposed into the second installation hole 121 of the corresponding second pivot base 12 from a position above said second pivot base 12, and each block 542 abuts a bottom surface of the corresponding first pivot base 11.

In another embodiment, the first connecting part 51 and the corresponding block 542 can jointly lock the main frame 30 on the corresponding first pivot base 11 from different arrangements, e.g. each first connecting part 51 can be disposed into the first installation hole 111 of the corresponding first pivot base 11 from a position below said first pivot base 11, each second connecting part 52 is then disposed into the second installation hole 121 of the corresponding second pivot base 12, and each block 542 abuts a top surface of the corresponding first pivot base 11, but the arrangement is not limited thereto.

When the user wants to open the safety gate 100, the user first holds the housing 541 of one of the adjusting assemblies 54, and pushes the pushing bottom 543 away from the adjacent wall-mounted assembly 10 until the bushing pushing bottom 543 moves back into the housing 541. Then the user lifts up the adjusting assembly 54, so the corresponding first connecting part 51, the connecting rod 53, and the second connecting part 52 are all moved upwardly. By moving upwardly, the first connecting part 51 and the second connecting part 52 are detached from the corresponding first pivot base 11 and second pivot base 12 respectively. Then the user pivots the main frame 30 along the other wall-mounted assembly 10 to open the safety gate 100.

When the user wants to detach the main frame 30 from the two wall-mounted assemblies 10, the user unlocks the main frame 30 from the two wall-mounted assemblies 10 by holding the housings 541 of the two adjusting assemblies 54, and pushes each pushing bottom 543 away from the adjacent wall-mounted assembly 10 until the bushing pushing bottom 543 moves back into the housing 541. Then the user lifts up the adjusting assemblies 54, so the corresponding first connecting part 51, connecting rod 53, and second connecting part 52 are all moved upwardly. By moving upwardly, the first connecting part 51 and the second connecting part 52 of each adjusting assembly 54 are detached from the corresponding first pivot base 11 and the second pivot base 12 respectively. Then the main frame 30 is capable of being detached from the two wall-mounted assemblies 10.

When the user wants to mount the detached main frame 30 on another two wall-mounted assemblies 10, the user first holds the housings 541 of the two adjusting assemblies 54, and pushes each pushing bottom 543 away from the adjacent wall-mounted assembly 10 until the bushing pushing bottom 543 moves back into the housing 541. Then the user moves down the adjusting assemblies 54, so the corresponding first connecting part 51, connecting rod 53, and second connecting part 52 are all moved downwardly, by moving downwardly, the first connecting part 51 and the second connecting part 52 of each adjusting assembly 54 are disposed into the corresponding first pivot base 11 and second pivot base 12 respectively; specifically, each first connecting part 51 and second connecting part 52 are respectively disposed into the first installation hole 111 and the second installation hole 121. After that, the user stops pushing the two pushing bottoms 543, so the two blocks 542 protrude out again from the corresponding housings 541 and abut the adjacent first connecting parts 51.

In an embodiment, each adjusting assembly 54 further comprises a second resilient element 544, one end of the second resilient element 544 is connected to the housing 541, and another end of the second resilient element 544 is connected to the pushing bottom 543, so when the pushing bottom 543 is pushed, the second resilient element 544 will be stretched, so when the force pushing the pushing bottom 543 is stopped, the second resilient element 544 can pull the pushing bottom 543 back to the initial place.

By the elasticity of the second resilient element 544, the block 542 can remain protruding out from the inside of the housing 541, so the block 542 can continuously abut the corresponding first pivot base 11.

With reference to FIGS. 1 and 7, specifically, for each adjusting assembly 54, it is mounted around the connecting rod 53 and one adjacent supporting rod 33. In an embodiment, each housing 541 further has a first passing hole 541*a* and a second passing hole 541*b*, and a through hole 542*a* is formed on the block 542. The connecting rod 53 is sequentially mounted through the first passing hole 541*a* and the through hole 542*a*, and the supporting rod 33 that is mounted through the adjusting assembly 54 is mounted through the second passing hole 541*b*. The connecting rods 53 are connected securely in the first passing hole 541*a*. A space formed inside the through hole 542*a* makes the block 542 movable relative to the connecting rod 53.

All the embodiments shown above can be mixed and paired to each other. For the clarity of the specification, a thorough combination of the embodiments is not detailed. However, unless a combination between two embodiments shown above contradicts the original structure of the embodiments, all of the possible combinations derived from the embodiments shown above are encompassed in the specification.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety gate comprising:

a main frame;

two connecting assemblies respectively mounted on two opposite sides of the main frame, each one of the two connecting assemblies movably mounted on the main frame and comprising a first connecting part; and a second connecting part arranged apart from the first connecting part; and two wall-mounted assemblies disposed on the two opposite sides of the main frame respectively, being adjacent to the two connecting assemblies respectively, and being detachably connected to the two connecting assemblies respectively, each one of the two wall-mounted assemblies comprising a first pivot base, the first connecting part of the adjacent connecting assembly detachably and pivotally connected to the first pivot base; and a second pivot base, the second connecting part of the adjacent connecting assembly detachably and pivotally connected to the second pivot base;

wherein the two connecting assemblies have a pivoting condition and a disassembling condition, in the pivoting condition, one of the two connecting assemblies is operated to make the first connecting part and the second connecting part of said connecting assembly detached from the first pivot base and the second pivot base of the corresponding wall-mounted assembly respectively, so the main frame is capable of pivoting along the other connecting assembly to open and close the main frame;

in the disassembling condition, both of the two connecting assemblies are operated to make the first connecting part and the second connecting part of each one of the two connecting assemblies detached from the first pivot base and the second pivot base of the corresponding wall-mounted assembly respectively, and the main frame is capable of being removed from the two wall-mounted assemblies.

2. The safety gate as claimed in claim 1, wherein each one of the two connecting assemblies further comprises a connecting rod movably connected to the main frame, the first connecting part and the second connecting part of said connecting assembly both mounted securely on the connecting rod; and an adjusting assembly mounted securely on the connecting rod;

wherein the adjusting assembly has a locked condition, and in the locked condition, the adjusting assembly makes the corresponding first connecting part connected securely to the main frame and to the corresponding wall-mounted assembly; and the adjusting assembly makes the corresponding second connecting part connected securely to the main frame and to the corresponding wall-mounted assembly.

3. The safety gate as claimed in claim 2, wherein the main frame further comprises a first horizontal rod, one end of the connecting rod of each one of the two connecting assemblies mounted through the first horizontal rod;

a second horizontal rod arranged apart from the first horizontal rod, another end of the connecting rod of each one of the two connecting assemblies movably connected to the second horizontal rod; and multiple supporting rods arranged apart from each other, each one of the multiple supporting rods having two opposite ends connected to the first horizontal rod and the second horizontal rod respectively;

wherein for each one of the two connecting assemblies, one end of the adjusting assembly that is away from the connecting rod is movably mounted on at least one of the supporting rods.

4. The safety gate as claimed in claim 3, wherein each one of the two connecting assemblies further comprises a first resilient element, and two opposite ends of the first resilient element are respectively connected to the second horizontal rod and the connecting rod of said connecting assembly.

5. The safety gate as claimed in claim 2, wherein each one of the two adjusting assemblies further comprises a housing, the first connecting part of said connecting assembly connected to the housing;

a block movably mounted in the housing, being capable of protruding out from the housing;

a pushing bottom connected to the block, wherein when the pushing bottom is moved toward the adjacent wall-mounted assembly, the block protrudes from the housing and abuts the first pivot base of the adjacent wall-mounted assembly, so the block and the first connecting part are disposed on two opposite surfaces of the first pivot base to prevent the first connecting part detaching from the first pivot base.

6. The safety gate as claimed in claim 5, wherein each one of the two adjusting assemblies further comprises a second resilient element, and two opposite ends of the second resilient element are respectively connected to the housing and the pushing bottom.

7. The safety gate as claimed in claim 1, wherein each one of the two wall-mounted assemblies further comprises a first installing hole formed on the first pivot base;

a second installing hole formed on the second pivot base, wherein a center line of the second installing hole and a center line of the first installing hole are coaxial, the first connecting part of the corresponding connecting assembly is disposed in the first installing hole, and the second connecting part of the corresponding connecting assembly is disposed in the second installing hole.

8. The safety gate as claimed in claim 1, wherein the main frame further comprises a first frame portion;

a second frame portion pivotally connected to the first frame portion, a pivot angle between the first frame portion and the second frame portion being from 0 degree to 180 degrees.

9. The safety gate as claimed in claim 8, wherein the main frame further comprises at least one extended frame detachably mounted between the first frame portion and the second frame portion, and therefore the first frame portion, the at least one extended frame, and the second frame portion are sequentially disposed.

10. The safety gate as claimed in claim 9, wherein each of the at least one extended frame is pivotally connected between the first frame portion and the second frame portion.

11. The safety gate as claimed in claim 1 further comprising multiple supporting units mounted on the main frame.

12. The safety gate as claimed in claim 11, wherein each one of the multiple supporting units is a wheel.

* * * * *